United States Patent [19]

Powell et al.

[11] 3,939,241

[45] Feb. 17, 1976

[54] METHOD FOR POWDER METALLURGY COMPACTING

[75] Inventors: Joseph W. Powell, Verona Borough; James N. Fleck, Upper St. Clair Township, Allegheny County, both of Pa.

[73] Assignee: Crucible Inc., Pittsburgh, Pa.

[22] Filed: Oct. 4, 1974

[21] Appl. No.: 511,963

[52] U.S. Cl. ..... 264/111; 264/102; 264/317; 264/334; 264/338; 72/258; 29/420.5; 29/423

[51] Int. Cl.[2] ..... B22F 3/02

[58] Field of Search ..... 264/111, 317, 334, 338, 264/DIG. 50, 102; 72/258; 29/420.5, 423

[56] References Cited

UNITED STATES PATENTS

| | | | |
|---|---|---|---|
| 1,081,618 | 12/1913 | Madden | 264/DIG. 50 |
| 2,298,908 | 10/1942 | Wentworth | 264/DIG. 50 |
| 3,200,442 | 8/1965 | Haller | 264/DIG. 50 |
| 3,671,230 | 6/1972 | Smythe et al. | 29/420.5 |

*Primary Examiner*—Robert F. White
*Assistant Examiner*—J. R. Hall

[57] ABSTRACT

A method for hot isostatically compacting powder metallurgy charges in sealed metal containers wherein the container may be easily removed from the charge after compacting by providing a separating medium between the container interior and the powder metallurgy charge to prevent bonding during subsequent hot isostatic compacting, and producing during hot isostatic compacting a residual stress in said container; slitting of the container after compacting releases the residual stresses and in the absence of bonding to the compact causes the container to move away from the compact, thereby avoiding typical container-removal operations such as machining and pickling.

2 Claims, 2 Drawing Figures

METHOD FOR POWDER METALLURGY COMPACTING

In the art of powder metallurgy it is known to place a powder metallurgy charge in finely divided particle form in a sealed metal container for compacting. Typically, the powder metallurgy charge may be of prealloyed powder, such as that formed by various of the conventional atomizing techniques, or may be a mixture of elemental particles constituting the desired final compacted article composition. The containers used for the purpose are generally made of mild steel having a wall thickness on the order of at least one-sixteenth in. In applications wherein hot isostatic compacting is achieved by the use of a gas, such as nitrogen or helium, in contact with the container exterior it is necessary that the container be impervious. In a typical application wherein high speed prealloyed powder is compacted to form billets the container is of mild steel and of generally cylindrical construction. Upon the application of fluid pressure the container collapses to permit compacting to the required density. Prior to compacting, the container is in the conventional manner outgassed to remove impurities, such as oxides, and after outgassing the container is sealed against the atmosphere. It is then heated to a temperature suitable for hot isostatic compacting to achieve the selected density. In the case of high speed steel this temperature may be on the order of 2000°F. The container and charge at this temperature are then placed in a gas pressure vessel, commonly termed an autoclave, and by the application of a gas, such as nitrogen or helium, at a pressure on the order of 10,000 to 15,000 psi hot isostatic compacting is achieved. During compacting in accordance with this well-known practice, the container becomes bonded to the compact. Typically, therefore after compacting and cooling to ambient temperature the container is removed from the compact by machining, pickling or a combination thereof. This is of course a time-consuming and expensive operation and in addition completely destroys the container so that it cannot be reclaimed for subsequent use, all of which adds to the overall expense of the powder metallurgy operation.

It is accordingly a primary object of the present invention to provide a method for hot isostatically compacting powdered metal charges in a sealed metal container wherein the container may be removed from the compact without requiring conventional removal operations such as machining, pickling or combinations thereof.

A more specific object of the invention is to provide a powder metallurgy operation wherein after compacting a sealed metal container may be removed from the compact by merely slitting the container, whereupon it will move away from the compact without further manipulation.

Figure 2:
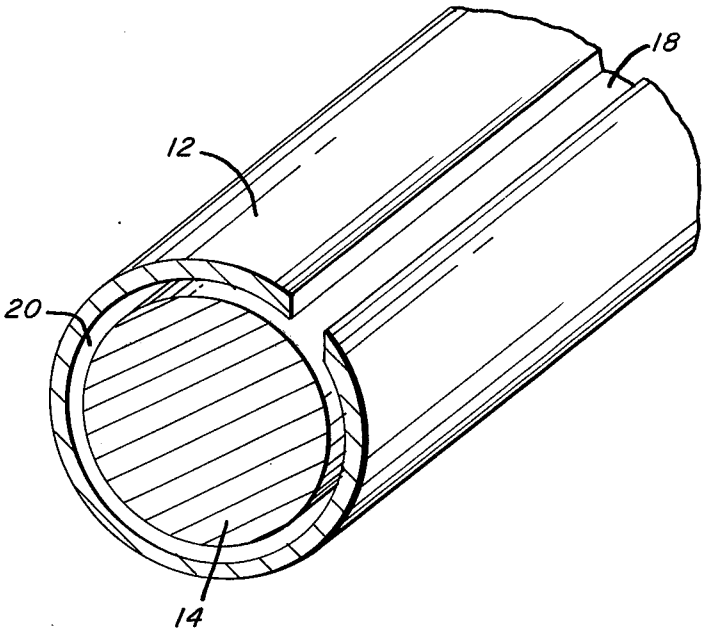
Figure 1:
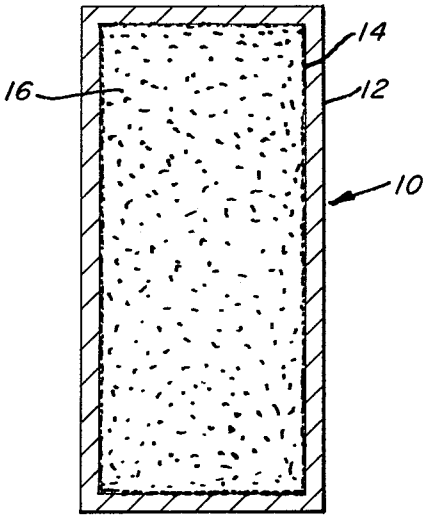

These and other objects of the invention, as well as a more complete understanding thereof may be obtained from the following description, specific examples and drawings, in which:

FIG. 1 is a schematic view in vertical cross section of one example of a powder-filled metal container suitable for use in the practice of the method of the invention; and FIG. 2 is a schematic view in partial section of the powder-filled container of FIG. 1 after compacting and slitting of the container to cause removal of the same from the compact.

Broadly, in the practice of the invention in the conventional manner a powder metallurgy charge is placed in a sealed metal container, and the container and charge are heated to an elevated temperature suitable for hot isostatic compacting. The heated container is then hot isostatically compacted by the application of fluid pressure to the exterior of said container to collapse the container and compact the charge therein to the desired density; the density achieved during compacting may be full density or to an intermediate density if a subsequent working operation is to be performed. The improvement of the invention comprises placing between the container interior and the charge, prior to heating and compacting a means for preventing bonding therebetween. This may constitute a separating medium layer, which may be applied to the interior of the container. The separating medium may be a coating of an oxide such as alumina or the like or an oxide may be formed, in situ, on the container interior. During compacting, bonding is prevented between the container and the charge and the container is residually stressed. Consequently, if the container is slit after compacting the residual stress is released and in the absence of bonding between the compact and container interior the container moves away from the compact with a spring-like action. The compact may then be readily removed without requiring significant manipulation or any container-removal operations, such as conventional pickling and machining. To insure that the residual stress in the container will be sufficient to cause the same to move away from the compact upon slitting thereof, it is preferred that the thickness of the container be at least one-sixteenth in., particularly when the container is of steel. The steel container is customarily used particularly when the particle charge is prealloyed powder of an iron-base alloy. With regard to the separating medium coating oxides such as alumina, which might be applied by flame spraying or other ceramics or natural oxides could be used. All that is required of the particular coating is that under the temperature and pressure conditions incident to hot isostatic compacting that bonding between the container interior and the compacted charge be avoided to the extent that upon slitting of the container the residual stress in the container will cause the same to move away from the compact and thus render the compact easily removable from the container.

As a specific example of the practice of the invention reference should be made to the drawings and particularly to FIG. 1 thereof. FIG. 1 shows an assembly, designated generally as 10, suitable for use and typical of an assembly that would be used in the production of high speed steel billets in accordance with the invention. The assembly 10 comprises a mild steel cylindrical container 12 having an interior, separating-medium layer 14 thereon. The container is filled with a powder metallurgy charge 16, which may be conventional high speed steel of AISI Type M2 with the particles being approximately −30 mesh U.S. Standard. As shown in FIG. 1 of the drawings the container 12 is sealed as would be the condition after outgassing had been performed and the container and charge were readied for heating to suitable hotisostatic compacting temperature. The container as shown in FIG. 1, upon heating to temperature, which might be achieved either in a furnace within a gas pressure vessel or in a furnace exterior of the gas pressure vessel. In any event, however, when the container and charge are at suitable temperature the same is then subjected to gas at a pressure sufficient to achieve compacting of the charge 16 to the desired density. In the case of high speed steel of the above-identified conventional composition a compacting temperature on the order of 2000°F with a compacting pressure of 13,000 psi would be sufficient to achieve a density exceeding 95% of theoretical density.

Upon compacting and removal of the assembly 10 from the autoclave, the same is permitted to cool to ambient temperature at which time the container 12 is slit longitudinally, as diagrammatically represented in FIG. 2 of the drawings. During heating and compacting the separating medium coating 14 on the interior of the container prevents significant bonding between the compacted charge and the container interior. Consequently, during longitudinal slitting of the container, indicated as 18 in FIG. 2, the residual stress produced in the container during hot isostatic compacting is released. This causes the container to move away from the compacted charge 14 with a spring-like action. This results in the assembly being substantially as shown in FIG. 2 with the interior of the container 12 moved away from the surface of the compacted charge 14 to provide a void therebetween, which is designated as 20 in FIG. 2. Preferably, prior to the slitting operation the ends of the container would be cropped off in the conventional manner as by a sawing operation.

Since the only alteration of the container to effect removal is the longitudinal slitting, it is possible to reclaim the container for subsequent use, as by repairing the slit by a welding operation and welding ends onto the container.

We claim:

1. In a method for isostatically compacting powder metallurgy charges by the application of fluid pressure by:

a. filling a generally cylindrical metal container with a powder metallurgy charge, b. sealing said container, c. outgassing said container, d. heating said container and charge to an elevated temperature, e. applying fluid pressure to the exterior of said heated container to isostatically compact said charge therein to produce a powder metallurgy compact, f. releasing said pressure and cooling said container and compact, and g. removing said compact from said container;

the improvement comprising:

h. applying to the interior surface of said container, prior to filling said container with said powder metallurgy charge, a separating medium layer for preventing bonding between said container and compact during application of said fluid pressure, said container being steel and having a wall thickness of at least one-sixteenth inch, said container collapsing under said applied fluid pressure and establishing residual stresses within said container following the release of said fluid pressure, and i. slitting said container to release said residual stresses, wherein said residual stresses within said container are sufficient to cause said container to spring open and move away from said formed compact therein.

2. The method of claim 1 wherein said powder metallurgy charge is prealloyed powder.

* * * * *